US005097985A

United States Patent [19]

Jones

[11] Patent Number: 5,097,985

[45] Date of Patent: Mar. 24, 1992

[54] BASEBALL SOFT-TOSS PITCHING MACHINE AND METHOD

[76] Inventor: Kenneth E. Jones, 2573 Fountainhead Dr., San Ramon, Calif. 94583

[21] Appl. No.: 531,467

[22] Filed: May 31, 1990

[51] Int. Cl.[5] ..... G07F 11/54

[52] U.S. Cl. ..... 221/86; 221/277; 124/48; 124/49; 273/26 P

[58] Field of Search ..... 221/265, 277, 282, 285, 221/203, 86, 15, 16; 273/26 D; 124/1, 48, 49, 50, 81, 83, 84, 85, 900

[56] References Cited

U.S. PATENT DOCUMENTS

| | | | |
|---|---|---|---|
| 2,828,048 | 3/1958 | Swanson | 221/277 |
| 2,955,824 | 10/1960 | Chanko | 273/26 D |
| 3,847,132 | 11/1974 | Schatz | 124/81 X |
| 3,878,827 | 4/1975 | Newgarden, Jr. | 124/81 |
| 3,894,657 | 7/1975 | Eckmayr | 221/265 |
| 4,132,214 | 1/1979 | Schnurr et al. | 124/1 |
| 4,207,857 | 6/1980 | Balka, Jr. | 124/50 X |
| 4,552,120 | 11/1985 | Nall et al. | 221/277 X |
| 4,621,746 | 11/1986 | Reichle et al. | 221/86 X |

FOREIGN PATENT DOCUMENTS

| | | |
|---|---|---|
| 183432A | 6/1986 | European Pat. Off. . |
| 54-31330 | 3/1979 | Japan . |

*Primary Examiner*—Robert P. Olszewski
*Assistant Examiner*—Dean A. Reichard
*Attorney, Agent, or Firm*—Philip A. Dalton

[57] ABSTRACT

A soft-throw machine is disclosed that dispenses softballs or baseballs or other articles one at a time (or alternatively, a selected plurality or multiplicity at a time) from a reservoir onto a chute for delivery to a hitting area where a person may strike the ball. In addition to its automatic dispensing, soft-throwing capability, the machine is specially designed for quiet operation to decrease the possibility that the striker or batter can anticipate delivery of the ball.

16 Claims, 2 Drawing Sheets 10
11
12
13
14
17
21
27
30
36
36A
36B
37
38
39
41
42
44

BASEBALL SOFT-TOSS PITCHING MACHINE AND METHOD

FIELD OF THE INVENTION

The present invention relates generally to the field of automatic ball delivery or throwing machines, such as machines for throwing baseballs, softballs and tennis balls.

BACKGROUND OF THE INVENTION

Soft-tossing is a technique for improving the handeye coordination and/or the bat speed of a softball or baseball batter. The technique is manual in that a pitcher stands to the side of the batter, typically just out of range of the batter's swing, and softly tosses the ball into the batter's strike zone. It is highly desirable to throw the ball without warning the batter in advance, so that the batter is unable to anticipate the delivery and, thus, so that the batter's ability to strike the ball truly is a function of hand-eye coordination, reflexes and bat speed. However, as will be readily appreciated, it is difficult to avoid giving advance warning when the ball is delivered manually, that is, tossed by hand.

SUMMARY OF THE INVENTION

Objects

In view of the above-discussion, it is one object of the present invention to provide a so-called soft-throw or soft-toss technique and machine which make it difficult to anticipate tossing or throwing of a ball to a batter or striker.

It is a related object to provide a soft-toss machine which delivers balls automatically.

It is another, related object to provide a soft-toss machine which is designed to operate relatively silently, and thereby make it difficult to anticipate when a ball will be tossed.

SUMMARY

In one aspect, an automatic ball delivery system which incorporates features of my invention comprises (1) a generally downwardly-extending chute including a chute for delivering balls by gravity to a hitting area; (2) a dispenser tank for automatically depositing balls into the upper end of the chute, including a housing defining a reservoir therein for balls having a dispensing opening at the side thereof, rotatable vane means mounted in the reservoir for delivering balls to the dispensing opening, the vane means having a multiplicity of blades forming ball-holding sections of selected size for holding a selected number of balls in given sections, a cover mounted between the ball reservoir and the vane and over the dispensing opening for limiting the number of balls dispensed from a given holding section to said selected number, and means for rotating the vanes; and (3) means for supporting the dispensing tank and the chute. The supporting means may be at least a pair of vertically-adjustable supports, one supporting the dispensing tank and chute at or proximate the dispensing tank and a second supporting the chute at a point spaced from the dispenser tank, for varying the height of the dispensing tank and the chute and the angle of the generally downwardly-extending chute.

Alternatively, the supporting means may comprise a single vertically-adjustable support adapted for varying the height at which the dispensing tank and chute are supported. The chute means may comprise a chute and a pair of longitudinally-extending spaced-apart ball support rails mounted for supporting balls traversing along the chute. Also, the chute may be enclosed or covered.

According to more specific aspects, the means for rotating the vane comprises an electric motor, which may be battery powered, and may be a variable speed motor for rotating the vane at a variable rate and thereby dispensing the balls at a variable rate.

Furthermore, the dispensing tank may comprise a reservoir having a bottom wall or partition and a separate chamber beneath said bottom wall; the means for rotating the vane may comprise an electric motor mounted in said separate chamber and having a rotatable shaft extending upwardly through the bottom wall of said reservoir and mounting said vane thereon or otherwise drivingly engaging said vane; and said cover may be generally triangular shaped, with the base thereof mounted to the wall of said reservoir above the dispensing opening and the end opposite the base journaled to the motor shaft or similarly mounted.

Alternatively, the chute may be generally straight for providing a soft drop of the ball, the chute may curve downwardly proximate the dispensing point for providing a controlled, soft-drop trajectory to the ball, or the chute may curve upwardly proximate the dispensing point for tossing the ball upwardly.

Preferably a ramp is disposed between the balldispensing opening and the chute and is oriented at a downward angle greater than that of the chute but less than a vertical angle, for providing a smooth traversal of balls from the dispensing opening to the chute.

In another aspect, my invention is embodied in a method for dispensing balls a selected number at a time, comprising, rotating a generally horizontal vane within a reservoir defining at least a plurality of ball-holding sections, to sequentially present the ball-holding sections to a dispensing opening, and confining the number of balls at the opening to that contained in the ball-holding section presented to the opening, for dispensing the selected number of balls into a chute for delivery to a selected area.

BRIEF DESCRIPTION OF THE DRAWINGS

The above and other aspects of the present invention are described with respect to the drawings, in which.

DETAILED DESCRIPTION OF THE PREFERRED EMBODIMENT(S)

Figure 1:
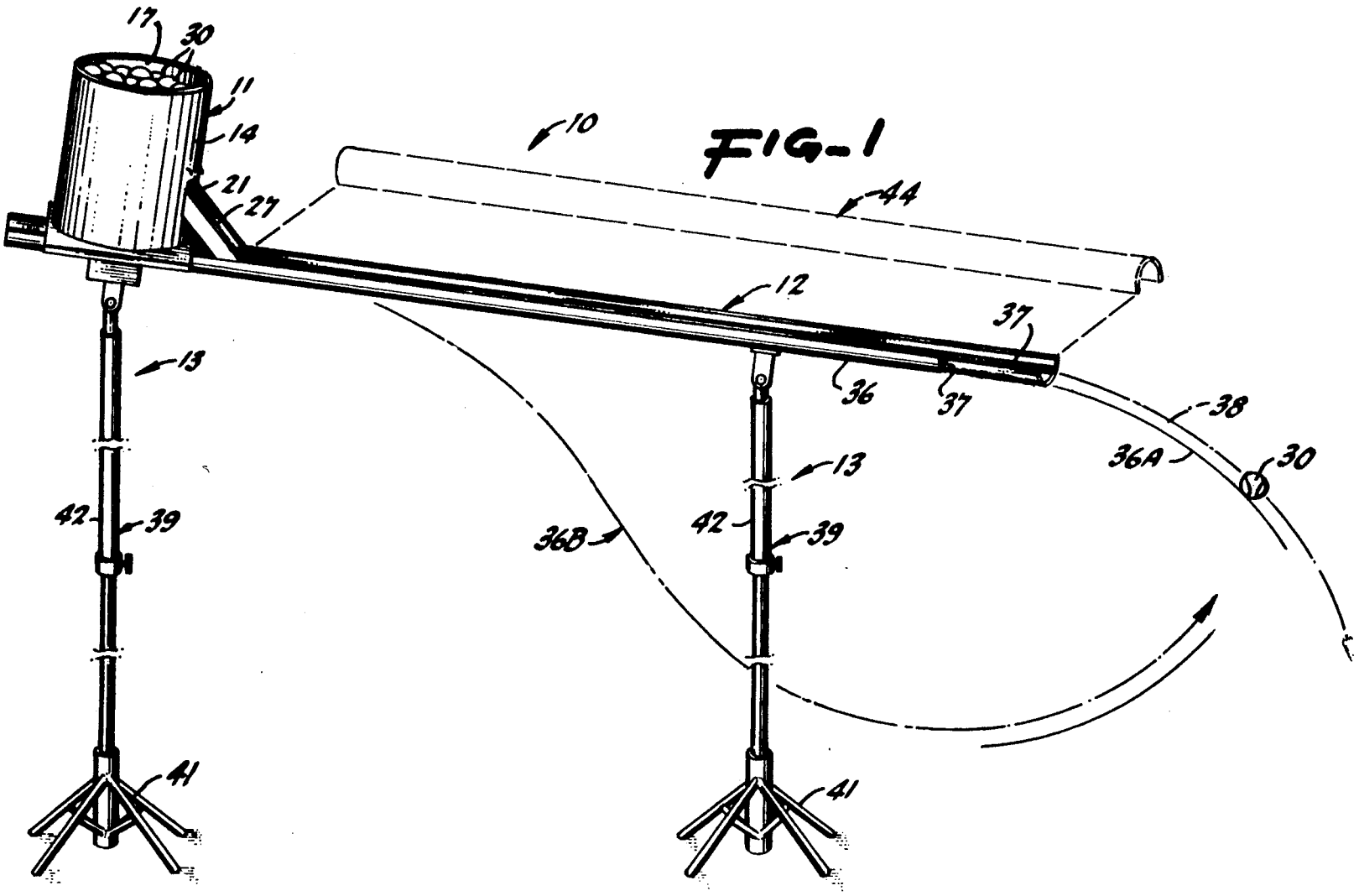
FIG. 1 is a perspective view of a presently preferred embodiment of my automatic ball-dispenser machine.

FIG. 1 is a perspective view of a presently preferred embodiment 10 of my soft-throw machine. The machine is useful for delivering various types of balls to a batter or striker, including baseballs, softballs and tennis balls.

Figure 2:
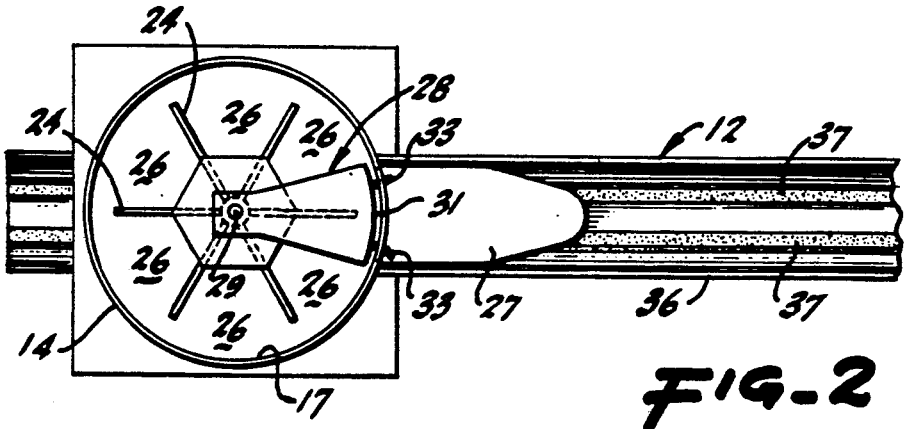
FIG. 2 is a top plan view of the dispenser tank depicted in FIG. 1.

The illustrated embodiment 10 comprises a combined ball tank and dispenser 11 (hereafter also termed dispenser tank or tank dispenser), a rail or chute delivery system 12 and support means 13 for the tank dispenser and the delivery chute. Referring also to the top plan view of the tank dispenser shown in FIG. 2 as well as the front view thereof shown in FIG. 3, the tank dispenser 11 comprises a cylindrical housing 14, preferably of lightweight durable, water-resistant material such as plastic, defined by an open top, cylindrical shell having an internal partition or wall 16 which divides the shell into an upper, ball storage tank 17 and a lower chamber 18 in which a motor 19 is mounted. The bottom partition or wall 16 of the tank 17 is convex, that is, slopes downwardly in the radially outward direction, thereby enabling gravity dispensing through the dispensing hole 21 in the side of the housing.

Motor shaft 22 extends through an opening in the bottom tank wall 16 into the bottom of the storage tank 17 and has mounted thereon a vane 23. As illustrated, the vane 23 comprises a multiplicity of blades 24 having length, height and between-blade spacing. selected to form rotatable ball-holding sections 26 along floor 16 of the tank. Obviously, the number of balls held by each section 26 will vary depending upon the circumference of the tank, the length of the blades, the between-blade spacing and the height of the blades. My present working system is designed to dispense one ball at a time, but the system can be adapted for dispensing two or more balls or articles from sections 26 at a time. A variable speed electric motor may be used, to provide quietness of operation and also to permit variation of the rotational speed of the shaft 22 and vane 23 to vary the rate at which balls are dispensed.

Figure 3:
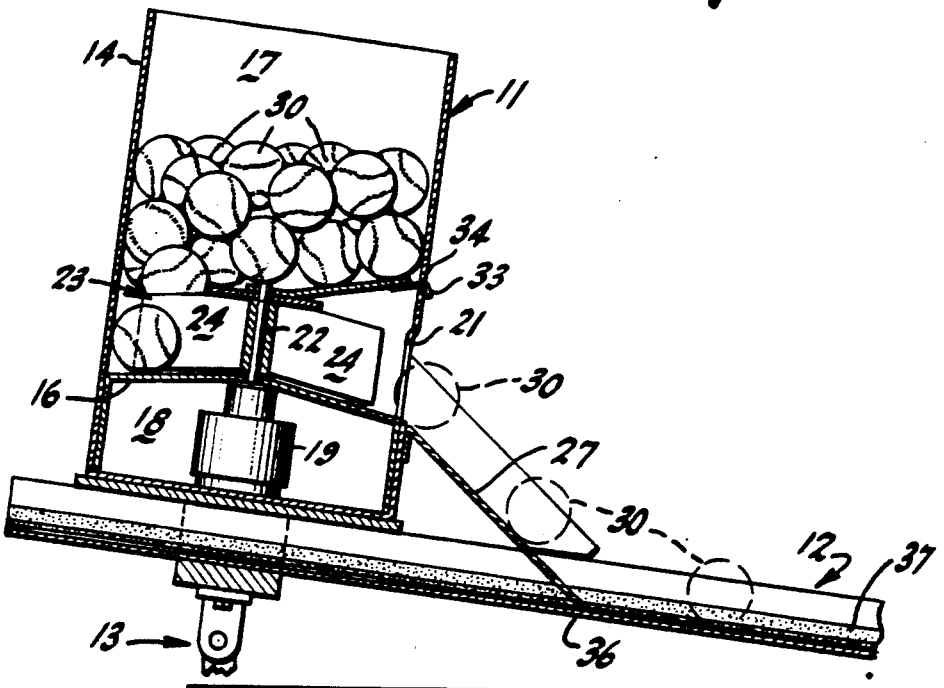
FIG. 3 is an enlarged, partial, front view of the dispenser tank showing the internal components thereof (including the partition, the vane, the cover and the motor) in phantom outline.

The ball dispensing hole 21 is located just above the bottom wall 16 of the tank and is of appropriate size to dispense balls one at a time onto a downward sloping, concave ramp 27 which is mounted between the dispensing hole and the chute delivery system 12. A cover 28 corresponding generally to the triangular shape and the size of the ball storage sections 26 is mounted at and above the dispensing hole 21: the inner cover end 29 is journaled to the motor shaft 22 and the opposite, outer end or base 31 is mounted to the outside wall of the tank 17. For example, L-shaped wire supports 33 mounted to the outer ends of the cover 28 extend through holes 34 in wall 14. As shown in FIG. 3, the cover 28 is positioned closely adjacent the top of the rotatable vane 23 so that the vane functions to push aside any balls which are resting on the ball in the ball-holding section 26 as that section is rotated to a position in front of the dispensing hole 21. The vane 23 also prevents any additional balls from dropping into the ball-holding section 26 which is in front of the dispensing hole. In short, the cover 28 acts as a ball-ejection inhibitor which limits the number of balls in the ball-holding section to the intended capacity of that section (here, one) when that section is positioned opposite the hole 21 and thereby ensures that no more than the intended number of balls is dispensed at a time.

Figure 4:
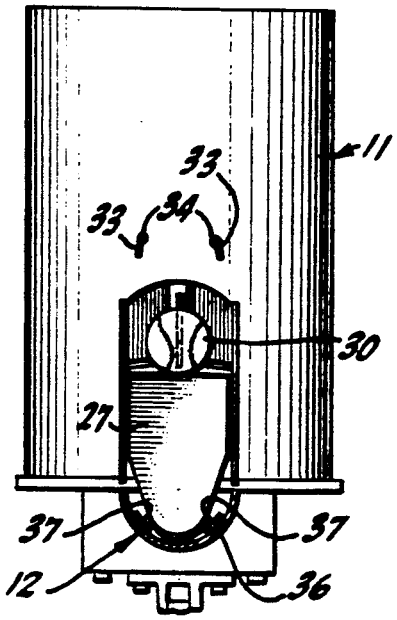
FIG. 4 is a partial, front view of the automatic ball dispenser of FIG. 1.

Referring now primarily to FIGS. 1 and 4, the chute delivery system 12 comprises an elongated chute or ramp 36 (illustratively the chute is concave, i.e., of semi-circular cross-section) which receives the balls 30 from the dispensing tank 11 and drops the balls at its opposite end along trajectory 38 to the batter (not shown). The chute 36 preferably is made of durable, water-impervious material such as plastic. Preferably, a pair of spaced foam rubber rails 37 (or foam rubber covered rails) are mounted longitudinally within the chute for providing silent, relatively vibration-free movement of the ball along the chute. A removable cover 44 may be positioned on the chute, to enhance quiet operation and to conceal movement of the balls. Alternatively, the covered chute may be a tube. In addition, the downwardly angled concave connecting ramp 27 extending from the ball dispensing hole 21 to the chute 36 provides a smooth transition from the hole 21 to the chute and this prevents the ball from audibly dropping onto the ramp.

As a result of the specially designed chute 12 and connecting ramp 27 and the above-described construction of the dispensing tank 11, operation of my ball-throwing machine 10 is devoid, or nearly so, of noises which indicate the positioning of the ball at the hole, dispensing of a ball onto the chute. That is noises which permit a batter to anticipate imminent delivery of a ball are suppressed. The primary sound is white noise resulting from the continuous operation of the motor and vanes and movement of the balls within the tank 17, which tends to mask any remaining low level noises associated with dispensing and delivery.

As shown in FIG. 1, the dispenser tank 11 and the chute delivery arrangement 12 are supported by support means 13 preferably comprising a pair of telescoping, vertically-adjustable supports or stands 39. The stands 39 each comprise a stable base 41 such as the illustrated tripod base, or an H-shaped base, etc., to which is mounted the vertically adjustable, telescoping upright member 42. Adjustment of the members 42 permits ready adjustment of the height of either or both of the stands 39, for example, to accommodate batters of different heights and/or to alter the angle of the chute 36 and therefore the delivery velocity of the ball 30.

Please note, the chute 36 and the dispenser tank 11 may be mounted to a platform or base (not shown) which in turn is mounted to one of the stands 39, with the chute being supported proximate its opposite end by the second stand 39. Alternatively, the dispenser tank 11 may rest on the chute 36 and may be moved to different positions along the chute.

Also, the chute 36 could be attached to the tank housing 14 or formed integrally with the tank housing, with the chute end immediately beneath (and perhaps defining) the bottom of dispensing hole 21. This alternative arrangement presumably eliminates the need for the connecting ramp 27.

The length of the chute 36 may be varied to accommodate different distances between the batter and the desired loading location of the dispenser tank 11. Where a relatively short chute 36 is used, it is possible to support it using a single stand 39. In this arrangement, it may be preferable to carefully position the dispenser tank 11 so that the preponderance of its weight is on the side of the stand 39 which is opposite the delivery end of the chute 36 to balance the weight of the system or, alternatively, to add balance weights to the system.

The described system is portable. Such portability is enhanced by the use of a single support 39 and by the use of a battery or other motor which does not require connection to a power source.

In operation, the motor 19 is turned on to rotate the vane 23. One or more balls are loaded into the tank 17 before and/or during rotation of the vane, so that the rotating ball-holding sections 26 of the vane, the cover 28 and the dispensing hole 21 cooperatively dispense balls 30 one at a time onto the ramp 27 and onto the chute 36 for delivery via a soft, vertically downward trajectory 38 to the batter.

Those of usual skill will understand that numerous other changes and modifications may be made which are within the invention as described and within the scope of the appended claims. For example, additional alternative embodiments may include curved delivery ramps. Referring to FIG. 1, the ramp may be downwardly curving at the delivery end to provide additional control of the path of the ball, as indicated by the ramp shown in phantom at 36A. Alternatively, the ramp may curve upwardly at the delivery end, as illustrated by the ramp depicted in phantom at 36B, to provide an upward delivery or throw. In addition, an automatic shut-off may be incorporated for the motor or a closable door may be provided for dispensing hole 21, to automatically shut off dispensing operation after each pitch or after a selected number of pitches.

As mentioned above, the use of a variable speed motor makes it difficult to anticipate delivery of a ball based upon timing of previous deliveries. Furthermore, instead of or in conjunction with a variable speed motor, a disk may be mounted on the shaft and driven by gearing so that it rotates at a speed different from the shaft. The disk contains ball openings preferably spaced at irregular intervals around the shaft. The difference in rotational speed between the vane and this disk and the staggered spacing of the openings in the disk provide varied storage of the balls in the ball-holding sections 26 and, thus, provide variation in the rate at which balls are dispensed.

Having thus described preferred and alternative embodiments of my invention, what is claimed is:

1. An automatic ball delivery system comprising:

generally downwardly-extending chute means for delivering balls by gravity to a hitting area;

a dispenser tank for automatically depositing balls into the upper end of the chute means, comprising: a housing defining a reservoir therein for balls having a dispensing opening at the side thereof; rotatable vane means mounted in the reservoir for delivering balls to the dispensing opening, said vane means having a multiplicity of ball-holding sections of selected size for holding a selected number of balls in given sections; a cover mounted between the ball reservoir and the vane and over the dispensing opening for limiting the number of balls dispensed from a given holding section to said selected number; and means for automatically rotating the vane means at a randomly varying rate to dispense the balls at a randomly varying rate; and means for supporting the dispensing tank and the chute means.

2. The ball delivery system of claim 1, wherein the support means comprises a pair of vertically-adjustable supports, one supporting the dispensing tank and chute means at or proximate the dispensing tank and the second supporting the chute means at a point spaced from the dispenser tank, for varying the height of the dispensing tank and the chute means and the angle of the downwardly-extending chute means.

3. The ball delivery system of claim 1, wherein the supporting means comprises at least a single vertically-adjustable support adapted for varying the height at which the dispensing tank and chute means are supported.

4. The ball delivery system of claim 1, wherein the chute means comprises a chute and a pair of longitudinally-extending spaced-apart ball support rails mounted along the chute for providing silent movement of balls traversing along the chute.

5. The ball delivery system of claim 1, wherein the means for rotating the vane comprises an electric motor.

6. The ball delivery system of claim 5, wherein the motor is battery powered.

7. The ball delivery system of claim 1, wherein the means for rotating the vane comprises a variable speed motor for rotating the vane at a varying rate and thereby dispensing the balls at a varying rate.

8. The ball delivery system of claim 7, wherein the motor is an electric motor.

9. The ball delivery system of claim 8, wherein the motor is battery powered.

10. The ball delivery system of claim 1, wherein the dispensing tank comprises a reservoir having a bottom wall or partition and a separate chamber beneath said bottom wall; and wherein said means for rotating the vane comprises an electric motor mounted in said separate chamber and having a rotatable shaft extending upwardly through the bottom wall of said reservoir and mounting said vane thereon or otherwise drivingly engaging said vane; and wherein said cover is generally triangular shaped and the base thereof is mounted to the wall of said reservoir above the dispensing opening and the end opposite the base is journaled to the shaft.

11. The ball delivery system of claim 1 or 10, wherein the chute is generally straight for providing a soft drop of the ball.

12. The ball delivery system of claim 1 or 10, wherein the chute curves downwardly proximate the dispensing point for providing a controlled, soft-drop trajectory to the ball.

13. The ball delivery system of claim 1 or 10, wherein the chute curves upwardly proximate the dispensing point for dispensing the ball upwardly.

14. The ball delivery system of claim 1, 4 or 10, further comprising a ramp disposed between the ball-dispensing opening and the chute means and oriented at a downward angle greater than that of the chute means but less than a vertical angle, for providing a smooth traversal of balls from the dispensing opening to the chute means.

15. A method of dispensing balls a selected number at a time, comprising: automatically rotating at a randomly varying rate a generally horizontal rotatable vane defining at least a plurality of ball-holding sections beneath a reservoir, to sequentially present the ball-holding sections to a dispensing opening in the reservoir at a randomly varying rate; and confining the number of balls at the opening to that contained in the ball-holding section presented to the opening, for dispensing the selected number of balls into a chute for delivery to a selected area.

16. The ball delivery system of claim 1, wherein the chute means comprises an elongated chute, a pair of longitudinally-extending spaced-apart ball support rails mounted within the chute for providing silent movement of balls traversing along the chute and an elongated mating cover for the chute, covering the rails collectively providing silent movement of balls traversing along the chute.

* * * * *